US007836814B2

(12) United States Patent
Lefebvre

(10) Patent No.: US 7,836,814 B2
(45) Date of Patent: Nov. 23, 2010

(54) METERING PUMP WITH A PROTECTED PUMP CHAMBER

(75) Inventor: Rémy Lefebvre, Radepont (FR)

(73) Assignee: Milton Roy Europe, Pont Saint Pierre (FR)

( * ) Notice: Subject to any disclaimer, the term of this patent is extended or adjusted under 35 U.S.C. 154(b) by 449 days.

(21) Appl. No.: 12/046,917

(22) Filed: Mar. 12, 2008

(65) Prior Publication Data

US 2008/0226478 A1 Sep. 18, 2008

(30) Foreign Application Priority Data

Mar. 13, 2007 (FR) ..... 07 01786

(51) Int. Cl.
*F04B 43/02* (2006.01)
*F04B 15/04* (2006.01)

(52) U.S. Cl. ..... 92/98 R

(58) Field of Classification Search ..... 92/98 R, 92/171.1

See application file for complete search history.

(56) References Cited

U.S. PATENT DOCUMENTS 2,496,711 A * 2/1950 Goddard ..... 92/40
2,753,804 A * 7/1956 Goss ..... 417/384
3,000,320 A * 9/1961 Ring ..... 92/98 R
3,212,448 A 10/1965 Johnston
3,781,141 A * 12/1973 Schall ..... 92/100
3,955,901 A * 5/1976 Hamilton ..... 417/395

FOREIGN PATENT DOCUMENTS

EP 0 214 394 3/1987
EP 1 134 414 9/2001

* cited by examiner

*Primary Examiner*—Thomas E Lazo
(74) *Attorney, Agent, or Firm*—Muncy, Geissler, Olds & Lowe, PLLC

(57) ABSTRACT

The invention provides a pump, in particular for a chemically reactive fluid, in which a pump head comprises at least two walls between which there is defined a pump chamber for pumping the fluid in question, one of the walls being stationary, the other wall being movable or deformable relative to the stationary wall by means of a drive or deformation device, at least the stationary wall being provided with a protective coating against the fluid, wherein the coating is constituted by a sheet of plastics material applied in leaktight manner against the wall at the periphery thereof, with the space between the protected surface and the coating sheet, within the zone where they make leaktight contact, being filled with an incompressible liquid.

5 Claims, 2 Drawing Sheets

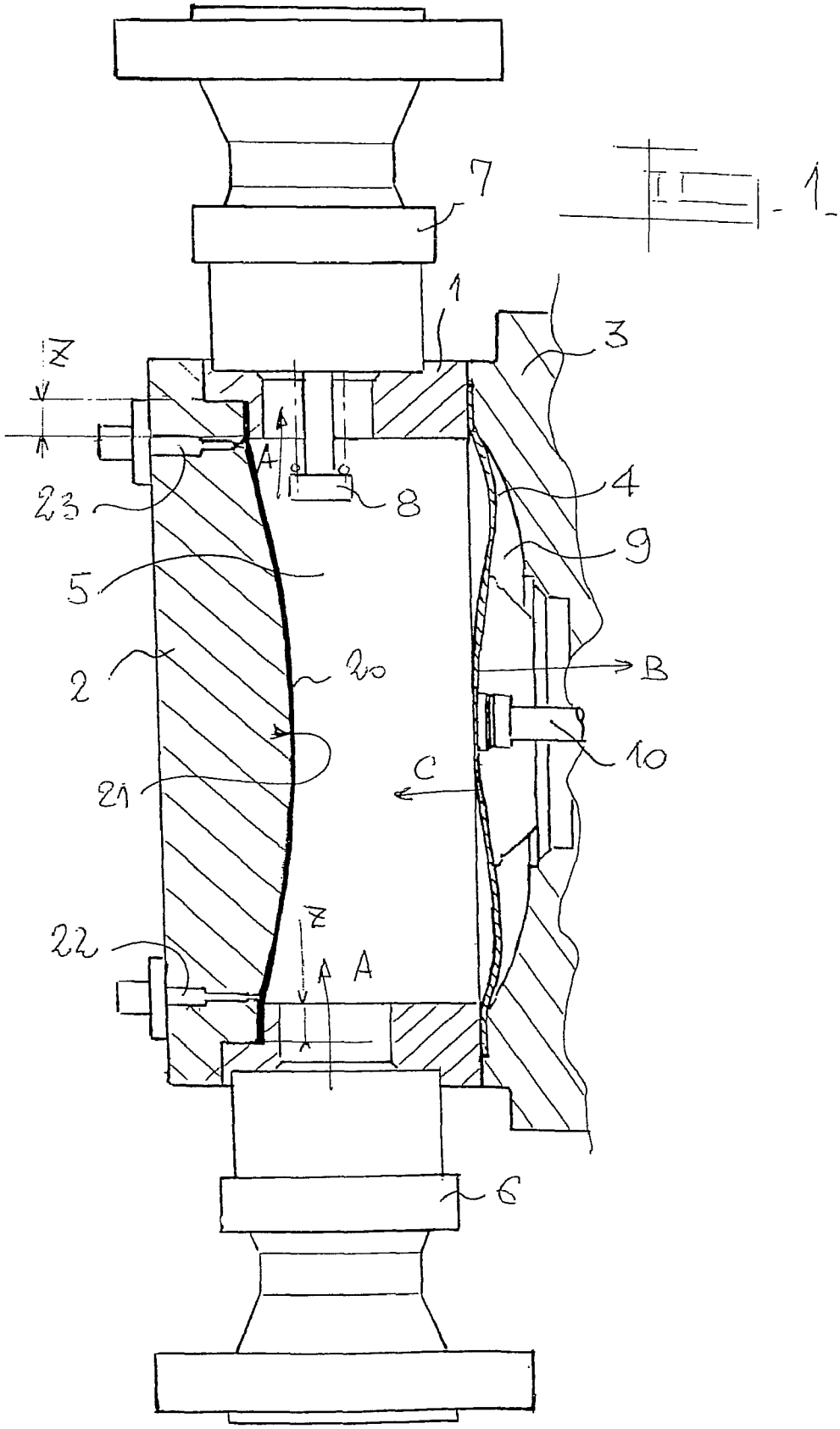
7
1
1
3
Z
A
23
8
4
9
5
2
20
B
10
C
21
Z
22
A
6

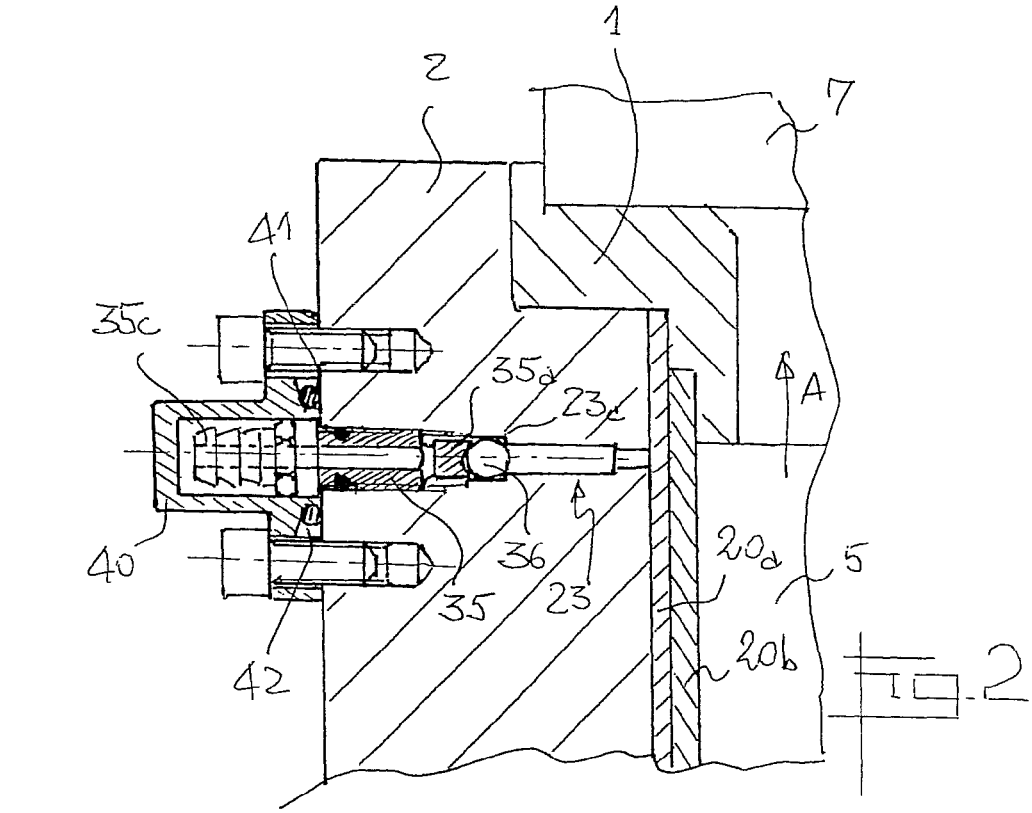
1
2
7
41
35c
35d
23c
A
40
36
20d
5
35
23
20b
42
2
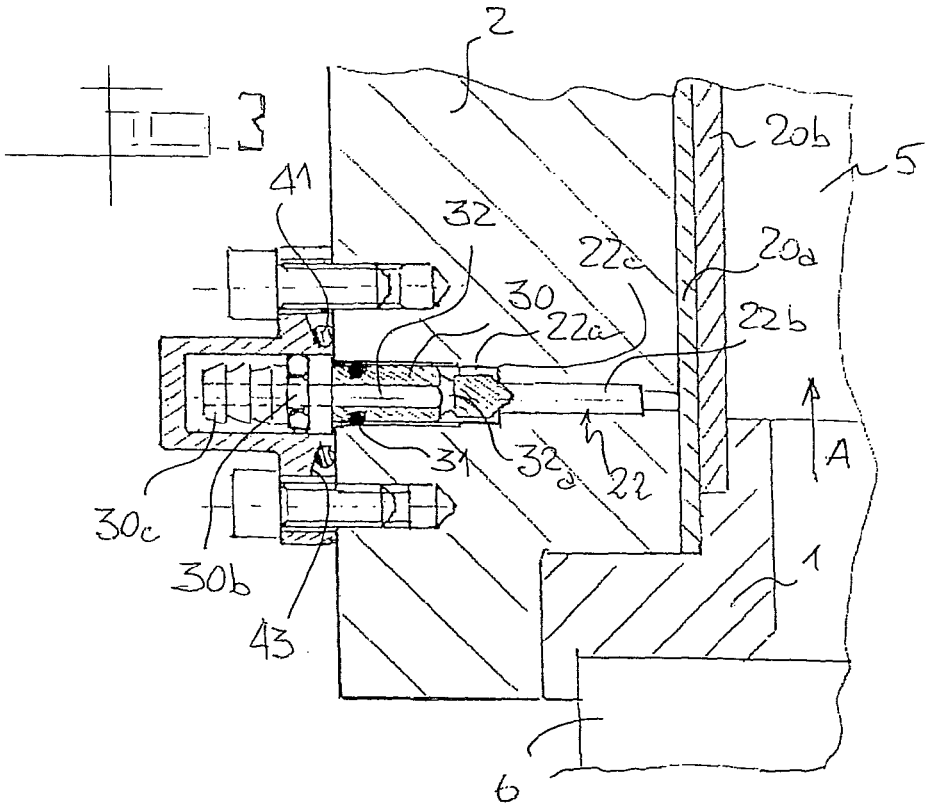
2
3
20b
5
41
32
22c
20d
30
22a
22b
A
31
32d
22
30c
30b
1
43
6

METERING PUMP WITH A PROTECTED PUMP CHAMBER

The invention relates to a metering pump for a fluid that is extremely corrosive.

BACKGROUND OF THE INVENTION

Such a pump conventionally comprises a pump head that defines a pump chamber, i.e. a chamber of volume that can be varied by deforming or moving a wall of the head. The chamber is secured to a structure that supports the pump head and that drive members that are coupled to the movable or deformable wall.

When said wall is a piston, the drive members are constituted by a linkage connecting the piston to a crank shaft having a single eccentric. When said wall is a diaphragm, which is a configuration with which the invention is mainly concerned, the drive members are either a direct mechanical transmission of the linkage kind, or else a hydraulic transmission with a working chamber on one side of the fluid proof diaphragm using a hydraulic fluid that is driven to move cyclically by a driving piston that urges the fluid towards the diaphragm under pressure, thereby reducing the volume of the pump chamber (pump delivery), or that sucks it back by moving the diaphragm in the opposite direction, thereby increasing the volume of the pump chamber (pump suction).

The pump head has an admission orifice and a delivery orifice, each provided with at least one check valve so that the fluid flows in one direction only through the pump chamber. The check valves are releasably secured to the pump head by means of valve boxes.

The aggressive nature of the pumped fluid leads to high-grade materials being used for those parts that come into contact with the fluid: stainless steel, special alloys, titanium, etc., which materials are particularly expensive.

Concerning the pump head, the most common shape is a body in the form of a substantially cylindrical ring having, on the outside, locations for receiving the valve boxes, closed at one of its ends by a side plate, and closed at its other end by the diaphragm which is clamped between the cylindrical body and the structure of the pump.

The closure side plate is a part that presents a large area in contact with the pumped fluid. It is also a bulky part, which can be extremely expensive when it is to be made of a material that presents a high degree of chemical inertness.

Proposals have been made to coat the surface of this part that faces towards the pump chamber, either by using a kind of vulcanization (see U.S. Pat. No. 2,753,804), or by applying a kind of skin, e.g. of polytetrafluoroethylene, shaped by molding and held in place by being clipped in the pump chamber (see U.S. Pat. No. 3,000,320).

Neither of those solutions is satisfactory: the first because there does not exist any chemically inert material capable of forming a coating that is securely bonded by adhesive or any other surface adhesion technique against the pressure and suction stresses that exist in a pump chamber, and the second because it is not possible to withstand such stresses merely by clamping a skin to a pump side plate. In addition, with a skin, the shaping of the skin, e.g. by molding, can turn out not to be accurately complementary to the surface of the side plate that is exposed in the pump chamber, or not to be sufficiently regular to ensure that no pockets of gas remain between the side plate and the skin, which pockets expand and contract on each pump cycle, thereby reducing the cylinder capacity of the pump.

The invention seeks to solve the question of passivating this surface that is exposed to the pumped fluid by proposing a coating for said surface by means of a skin that is perfectly coated to the shape of the protected surface so that no damage of mechanical origin or as a function of fatigue over time can affect the protection.

BRIEF SUMMARY OF THE INVENTION

The invention thus provides a pump, in particular for a chemically reactive fluid, in which a pump head comprises at least two walls between which there is defined a pump chamber for pumping the fluid in question, one of the walls being stationary, the other wall being movable or deformable relative to the stationary wall by means of a drive or deformation device, at least the stationary wall being provided with a protective coating against the fluid, wherein the coating is constituted by a sheet of plastics material applied in leaktight manner against the wall at the periphery thereof, with the space between the protected surface and the coating sheet, within the zone where they make leaktight contact, being filled with an incompressible liquid.

The composite material formed by the liquid and the sheet of plastics material constitutes a material that is not deformable under the effect of the alternating pressure and suction that occurs in the chamber. Since the liquid completely fills the space between the surface and the sheet, it has expelled any bubble of gas that might, by virtue of its compressibility and thus of the variation in its volume, have left the sheet with freedom to deform relative to the wall it is protecting, where such deformation would reduce the cylinder capacity of the pump and would have given rise to fatigue stress in the sheet, leading rapidly to the sheet being torn.

This disposition also most advantageous in terms of manufacture. With ordinary machining, it is known that it is not possible to obtain an extremely polished surface on the surface of the side plate. Furthermore, it is not possible to master the shape of the sheet (e.g. a spherical cap) using known manufacturing methods. There will always be curvature irregularities forming bulges and depressions facing the surface of the side plate, and thus leading to pockets of gas, particularly when the dimensions of the pump are large (e.g. a pump head having an outside diameter of 300 millimeters (mm) to 450 mm). The invention makes it possible to avoid any need to master accurately the shapes and the surface states of the side plate and of the sheet. It thus enables manufacture to be inexpensive.

Furthermore, the greater the resistance of the protective sheet to surface elongation, the less the liquid is sensitive to variations of pressure in the pump chamber. Consequently, less stress is applied to the leaktight zones and the risks of leaks are reduced, even when using gaskets or valves of excellent quality, thereby procuring an advantage of longer life for the pump.

This surface strength can be imparted to the sheet in at least two different ways.

The first consists in shaping the sheet as a substantially spherical or conical cap, complementary to the inside surface of the side plate so as to match it as exactly as possible, with the convex side of this shape facing towards the inside of the chamber.

The second consists in putting a protective plate into place on the surface of the sheet that faces towards the pump chamber, which protective plate is made of a high-grade material that presents good resistance to corrosion.

Finally, the pump is fitted with means for enabling the protective sheet to be put into place properly in simple manner, either during initial assembly of the pump, or whenever it is reassembled after regular maintenance operations. These means comprise two orifices formed in the side plate and opening out in the immediate proximity of the leaktight zone between the sheet and the pump head, one of the orifices being in the lowest portion and the other orifice being in the highest portion of the pump chamber, and each orifice having a threaded plug for closing it. Each of the plugs is protected by a respective cap resting against an outside surface of the side plate via a bearing face that includes an O-ring surrounding the plug and received in a groove having a conical bottom that enables the O-ring to expand radially under the effect of fluid under pressure coming from the plug, thereby creating a leak of said fluid between the cap and the side plate.

BRIEF DESCRIPTION OF THE DRAWINGS

Other characteristics and advantages of the invention appear from the following description of an embodiment thereof.

Reference is made to the accompanying drawings, in which:

FIG. 1 is an axial section view of the pump head of a diaphragm pump of the invention;

FIG. 2 is an axial section view showing a detail of the FIG. 1 head; and FIG. 3 shows another detail of the head.

DETAILED DESCRIPTION OF THE INVENTION

The pump head shown in FIG. 1 comprises, in known manner, a cylindrical ring 1 having a side plate 2, in the form of a solid disk, fitted to its left flank, by means of peripheral screws (not shown), while its right flank is fitted onto a pump structure 3 that encloses and supports all of the drive members thereof. A deformable diaphragm 4 is clamped between the ring and the structure. The pump chamber 5 is thus defined by the ring 1, the side plate 2, and the diaphragm 4. A valve box 6 constitutes means for connecting the pump chamber 5 to a suction pipe (not shown) via at least one check valve that allows fluid to pass in direction A. Delivery from the pump likewise comprises a valve box 7 with a check valve including a tail 8 and likewise passing fluid in direction A. The diaphragm 4 is moved with a suction stroke in direction B and a delivery stroke in direction C by means of a hydraulic fluid contained in a working chamber 9, that also includes a conventional device 10 for compensating leaks.

It can be understood on sight of this drawing that the side plate 3 constitutes the part presenting the largest area of contact with the pumped fluid. In order to eliminate direct contact between the side plate 3 and the fluid, a coating 20 is placed on the surface of the side plate that faces towards the pump chamber 5. This coating is preferably a sheet of polytetrafluoroethylene (PTFE) of thickness lying in the range 1 mm to 5 mm. For pumps having a diameter of about 400 mm, for example, the selected thickness would be 4 mm. PTFE is a rigid material, such that a significant thickness confers thereon undeformability that is advantageous for obtaining good behavior of the pump over time.

As shown in the figure, the sheet 20 as obtained by injection molding is in the form of a spherical cap so as to match the surface 21 of the same shape as the side plate 2. The sheet 20 is clamped between the ring 1 and the side plate 2 by a peripheral zone Z such that its contact in said zone with the surface 21 is leaktight contact (with the same applying to contact with the ring 1). The spherical cap shape of the sheet constitutes an additional geometrical factor contributing to its ability to withstand deformation caused by pressure variations in the chamber 5.

The side plate 2 is pierced by two orifices 22 and 23 that open out into the chamber 5, one of them, 22, in the bottom portion of the chamber at the edge of the zone 2, and the other, 23, in the top portion of the chamber, likewise at the edge of the zone Z. It is thus possible to insert between the sheet 20 and the side plate 2 a film of incompressible liquid, e.g. oil coming from the bottom orifice 22. The liquid is forced into this space by means of a pump so as to cause it to invade the space progressively until it exits via the top orifice 23. This ensures that all of the interstitial air remaining between the sheet and the side plate has been expelled. The orifices are then closed. The pump is then ready to operate without loss of cylinder capacity and without subjecting the sheet 20 to mechanical stress and fatigue.

FIGS. 2 and 3 show details of the pump in the vicinity of the orifices 22 and 23. These figures show elements that are descried above and that are given the same references.

The bottom orifice 22 is suitable for receiving a threaded plug having an O-ring 31 and a central channel 32 that opens out via a transverse channel 32*a* into a section 22*a* of the orifice 22. This section communicates with the final section 22*b* of the orifice 22 via a seat (a constriction) 22*c* that can be closed by the conical end 30*a* of the threaded plug 30. The free end of the plug presents a driving hexagon 30*b* surmounted by a serrated connection endpiece 30*c* for temporary connection of the orifice 22 to a source of fluid under pressure (not shown).

It will be understood that when the space between the side plate and the sheet has been filled completely, it suffices for the operator to tighten the plug fully home so as to cause its conical end 30*a* to bear against the seat 22*c*, which end was previously kept away therefrom by the pump being screwed only part of the way into the orifice, so as to allow the interstitial fluid to pass.

Another threaded plug 35 is put into place in the orifice 23. In a basic version that is not shown, the plug is merely a cone-pointed screw (with a central channel and a transverse channel as for the plug 30) that is used to plug the constriction 23*c* in this orifice. In the version shown, the plug 35 has a conically-shaped end 35*a* for centering a ball 36 which can thus be pressed against the seat 23*c* by the plug or which, on partial loosening, can be left free between the seat and the centering cone. The advantage of this structure is that once interstitial fluid has been out into place, the feed plug is closed and the pump is actuated over a few suction/delivery cycles in order to completely degas the space between the side plate and the sheet. The ball then acts as a check valve that enables fluid or gas to escape on each delivery stroke while closing the channel 23 during each suction stroke. Once a few cycles have been completed, the plug 35 is tightened so as to close the orifice 23 completely.

It should finally be observed that each of these figures shows a cap 40 that can cover the endpiece 30*c*, 35*c* of each of the plugs in order to protect it from external dirtying. The special feature of the cap lies in the fact that it is clamped against the outside face of the side plate 2 in leaktight manner by means of an O-ring 41 that is received in a groove (or setback) 42 having a conical bottom 43. When the cap is put into place, the O-ring is lightly compressed between the side plate 2 and the bottom 43 of the groove. If a leak occurs via a cap plug, the fluid that accumulates in the plug tends under the increasing pressure on each stroke of the pump, to expel the O-ring 41 outwards. The O-ring is designed to expand and thus to occupy a location in the groove where its compression disappears, given the conical shape of the bottom 43 of the groove. The liquid can then leak out, constituting a warning sign for the operator, and above all preventing the fluid under pressure from expelling the cap and thus losing the protection provided for the plug endpieces.

Finally, FIGS. 2 and 3 show a variant embodiment of the protection for the side plate in which the sheet 20*a* is plane but is covered by a metal sheet 20*b* that gives it the ability to withstand pressure variations in the chamber 5 without deforming. This sheet is likewise clamped at its periphery between the ring 1 and the side plate 2 of the pump head.

In a more sophisticated pump, the plug 35 is not totally tightened and the space between the sheet and the side plate permanently communicates with a detector similar to the one disclosed in FR 2.533.636 for a fluid which could escape trough the ball valve 36 because a failure of the protective sheet.

What is claimed is:

1. A pump, in particular for a chemically reactive fluid, in which a pump head comprises at least two walls between which there is defined a pump chamber for pumping the fluid in question, one of the walls being stationary, the other wall being movable or deformable relative to the stationary wall by means of a drive or deformation device, at least the stationary wall being provided with a protective coating against the fluid, wherein the coating is constituted by a sheet of plastics material applied in leaktight manner against the wall at the periphery thereof, with the space between the protected surface and the coating sheet, within the zone where they make leaktight contact, being filled with an incompressible liquid.

2. A pump according to claim 1, wherein the sheet is in the shape of a substantially spherical or conical cap complementary to the inside surface of the side plate so as to fit against it as closely as possible, with the convex side of this shape facing towards the inside of the chamber.

3. A pump according to claim 1, having a protective plate for protecting the surface of the sheet that faces towards the pump chamber.

4. A pump according to claim 1, including means for filling the space between the side plate and the sheet with fluid, which means are constituted by two orifices, formed in the side plate and opening out in the immediate proximity of the leaktight zone between the sheet and the pump head, one of the orifices being in the lowest portion and the other orifice being in the highest portion of the pump chamber, and each orifice having a threaded plug for closing it.

5. A pump according to claim 1, wherein each of the plugs is protected by a respective cap resting against an outside surface of the side plate via a bearing face that includes an O-ring surrounding the plug and received in a groove having a conical bottom that enables the O-ring to expand radially under the effect of fluid under pressure coming from the plug, thereby creating a leak of said fluid between the cap and the side plate.

* * * * *